US010149506B2

(12) United States Patent
Stoka

(10) Patent No.: US 10,149,506 B2
(45) Date of Patent: Dec. 11, 2018

(54) NON-ADHESIVE FALSE EYELASH SYSTEM AND METHOD

(71) Applicant: One Two Cosmetics, LLC, Woodland Hills, CA (US)

(72) Inventor: Katy Stoka, Miami Beach, FL (US)

(73) Assignee: ONE TWO COSMETICS, LLC, Miami Beach, FL (US)

( * ) Notice: Subject to any disclaimer, the term of this patent is extended or adjusted under 35 U.S.C. 154(b) by 0 days.

(21) Appl. No.: 15/939,103

(22) Filed: Mar. 28, 2018

(65) Prior Publication Data

US 2018/0235299 A1 Aug. 23, 2018

Related U.S. Application Data

(63) Continuation of application No. 14/801,198, filed on Jul. 16, 2015.

(60) Provisional application No. 62/105,089, filed on Jan. 19, 2015.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A41G 5/0026; A41G 5/0073; A41G 3/0033
USPC ..... 132/201
See application file for complete search history.

(56) References Cited

U.S. PATENT DOCUMENTS

| | | | | |
|---|---|---|---|---|
| 3,862,453 | A | 1/1975 | Widdifield | |
| 5,741,336 | A | 4/1998 | Fraser | |
| 7,600,519 | B2 | 10/2009 | Dinh | |
| 8,061,367 | B2 * | 11/2011 | Rabe | A41G 5/02 132/216 |
| 2007/0227550 | A1 * | 10/2007 | Merszei | A41G 5/02 132/53 |

* cited by examiner

*Primary Examiner* — Tatiana Nobrega
*Assistant Examiner* — Brianne Kalach
(74) *Attorney, Agent, or Firm* — Lewis Brisbois LLP; Jon Hokanson

(57) ABSTRACT

A false eyelash system comprised of upper and lower eyelash assemblies, each including a magnetic and/or metallic element, the assemblies are frictionally secured through magnetic attraction to the wearer's natural eyelash which is sandwiched therebetween.

10 Claims, 8 Drawing Sheets

NON-ADHESIVE FALSE EYELASH SYSTEM AND METHOD

CLAIM OF PRIORITY

This application is a continuation of and claims the benefit of priority of U.S. application Ser. No. 14/801,198, filed Jul. 16, 2015, which is a non-provisional patent application that claims the benefit of priority of United States provisional patent application 62/105,089 filed on Jan. 19, 2015, the contents of each of which are incorporated herein by reference.

FIELD OF INVENTION

The invention relates generally to false eyelashes and in particular to false eyelashes that are secured to the wearer's real eyelashes by non-adhesive means, such as by magnetic force.

BACKGROUND OF THE INVENTION

False eyelashes, and the reason for wearing them, are well known in the cosmetic arts. People are often dissatisfied with the look of their eyelashes or simply wish to don eyelashes that are more suitable to a particular occasion. False eyelashes can have different curl, color, fullness, length, or other physical characteristics which can enhance the appearance of the wearer. While eyelash-enhancing cosmetic products, such as mascara, are available to improve these characteristics, even greater enhancements are possible through the use of false eyelashes.

False eyelashes typically consist of synthetic, human or animal hairs that are attached or tied to an elongated substrate. The substrate can be a textile or non-woven material having a skin-facing surface and an outward-facing surface. The false eyelash hairs are tied or adhered to the outward-facing surface. The skin-facing surface is impregnated with a pressure-sensitive adhesive that is used to temporarily affix the false eyelash to the wearer's eyelid. Alternatively, an adhesive substance can be applied directly to the eyelid and the false eyelash is then attached to the eyelid by placing the skin-facing surface over the adhesive substance.

False eyelashes in the prior art suffer from a number of disadvantages. These disadvantages include but are not limited to the following. First, they are typically single-use items. That is, once applied and removed they may not be reused. The act of applying adhesive and removing a false eyelash has a tendency to deform the substrate and/or eyelash hairs. Therefore, after one use, the false eyelash must usually be discarded. Second, false eyelashes are difficult to apply. Often, the false eyelash is not perfectly aligned with the wearer's eyelid and must be re-applied. If the adhesive bond has set in, removing the eyelash in order to relocate it can result in deformation of the false eyelash and the need to use a new false eyelash. Third, the adhesive materials used in prior art false eyelashes can irritate some wearers' eyes and/or skin and can often leave a residue on the wearer's eyelid which is often difficult to remove. Fourth, the adhesive materials used in prior art false eyelashes can lose holding power as it is exposed throughout the day to oils secreted by the wearer's eyelid, resulting in false eyelashes that come loose from the eyelid. Fifth, false eyelashes in the prior art are limited in the number of hairs that can be applied to the substrate and therefore sometimes do not add sufficient fullness to the wearer's eyelashes.

SUMMARY OF THE INVENTION

It is an object of the present invention to overcome the disadvantages of existing false eyelash systems by providing a false eyelash that can be easily and conveniently reused. It is a further object of the present invention to provide a false eyelash system that is easy to apply and inherently aligns itself to the wearers' eyelid. It is a further object of the present invention to provide a false eyelash that does not use adhesives and does not irritate the wearer's eye or eyelid skin and does not leave any residue on the user's eyelid. It is a further object of the present invention to provide a false eyelash that does not physically contact the wearer's eyelid when installed. It is yet a further object of the present invention to provide a false eyelid with enhanced fullness relative to false eyelashes in the prior art.

These and other objects are achieved through the false eyelash system of the present invention as described in the following disclosure.

The false eyelash system of the present invention can be applied to the eyelash in the upper eyelid of the wearer and/or the lower eyelid of the wearer, and to either the left or right eye of the wearer. For ease of reference and to avoid redundant description, unless otherwise stated the description in the present disclosure references application to the eyelash located in the upper eyelid of the wearer. Although there may be dimensional or ornamental differences in eyelashes applied to the various locations, the construction and method for application to each such location is essentially the same.

The false eyelash system of the present invention consists of two primary eyelash assemblies: An upper eyelash assembly and a lower eyelash assembly. Both the upper and the lower eyelash assemblies consist of a substrate strip of narrow and elongated construction. The substrate strip is long enough to substantially cover at least a portion of a wearer's eyelid edge and, optimally, can be shaped to mirror the contour of the eyelid edge. Thus, the false eyelash system of the present invention may include false eyelashes that cover the entire length of the eyelash, a portion of the eyelash, eyelash tips, or even a single eyelash hair. The substrate can be composed of a textile, a non-woven material, a polymer, or other suitable material that is thin, flexible, lightweight, and can be readily adaptable to the adhesion of eyelash hairs and metallic components. Each substrate strip has an upward facing surface and an opposite downward facing surface.

Eyelash hairs (be they human, animal or synthetic) are attached to the surface of the substrate in a generally perpendicular direction relative to the longitudinal axis of the substrate strip. In the case of the upper eyelash assembly, the hairs are preferably attached to the upward facing surface of the substrate strip. In the case of the lower eyelash assembly, the hairs are preferably attached to the downward facing surface of the substrate strip. However, attachment to either surface of the substrate strip is acceptable.

One or more non-adhesive attractive elements, in one embodiment magnetic elements, are attached to the upper eyelash substrate strip, preferably to its downward facing surface. The magnetic elements can be placed at discrete locations along the substrate surface or can cover the entire substrate surface. The magnetic elements can be composed of an inherently magnetic material, such as neodymium. Alternatively, the magnetic element can be composed of a magnetizable material such as magnetite or any other ferrous material which is magnetized after application to the substrate, and periodically re-magnetized. Because magnetic force will penetrate the substrate strip, when magnetic elements are used they may be attached to either surface of the substrate strip. Alternatively, the magnetic elements may be placed on the lashes.

The magnetic elements may be formed in one of several ways. One way is to magnetize a material such as magnetite or another ferromagnetic material that is embedded into a polymer in the substrate. One such method is to expose the magnetite or ferromagnetic material to a strong magnetic field. Other methods of magnetization exist and may be applicable to this invention.

Alternatively, the magnetic elements may be manufactured from inherently magnetic materials such as neodymium or samarium-cobalt. To produce a magnetic element, small uniform sized particles of the material can be incorporated into a polymer coating, such as a nylon-6 polymer or nitrocellulose, which allows the magnetic field to penetrate beyond the substrate. After the particles have been incorporated into the coating, the coating is then cured. Then, the coating can be applied permanently to the substrate. Similar to a polymer coating, a plastic material can be embedded with such magnetic, or magnetizable, particles through methods that are known in the art.

In corresponding fashion, one or more metallic elements are attached to the lower eyelash assembly's substrate strip, preferably to its upward facing surface. The metallic elements are composed of a material that is magnetically attractive, such as many ferrous materials, so as to engage the magnetic elements in the upper eyelash assembly. If the magnetic material is located at discrete locations along the length of the upper eyelash assembly's substrate, then the metallic elements can be placed at corresponding locations along the length of the lower eyelash assembly's substrate. Alternatively, the metallic element can cover the entire length of the lower eyelash assembly's substrate. Alternatively, the magnetic elements may be placed on the lashes. The metallic elements described above can be manufactured using the same techniques as those described for the magnetic elements. As with the attractive elements in the upper eyelash, because magnetic force will penetrate the substrate strip, the metallic elements of the lower eyelash may be attached to either surface of the substrate strip.

Although the above embodiment describes an upper eyelash assembly with magnetic element(s), and a lower eyelash assembly with metallic element(s), the reverse embodiment is equally feasible. That is, the upper eyelash assembly can be equipped with metallic element(s) and the lower eyelash assembly with magnetic element(s). A third alternative embodiment is also possible in which both the upper and lower eyelash assemblies are equipped with magnetic elements having opposite polarities and thus ensuring magnetic attraction between them. Alternatively, the magnetic elements may be placed on the lashes.

In use, the false eyelashes of the present invention are applied by placing the upper eyelash assembly directly above the wearer's natural eyelash and along the edge of the wearer's eyelid. Simultaneously, the lower eyelash assembly is placed directly below the wearer's natural eyelash and along the edge of the wearer's eyelid. As the upper and lower assemblies are moved closer together, magnetic force between the magnetic and metallic elements in the assemblies cooperatively engage the two assemblies with the wearer's natural eyelash "sandwiched" between the two assemblies. The magnetic force is sufficient to keep the two assemblies cooperatively engaged and frictionally secured to the wearer's natural eyelash.

To remove the false eyelashes of the present invention, the two assemblies can be pulled apart until the magnetic force is overcome. Alternatively, the assemblies, still magnetically engaged, can be slid forward along the wearer's natural eyelash until they disengage the natural eyelash. They can then be separated for storage.

It will be noted that the present invention achieves the above-stated objects by providing a fully-reusable, easy to apply remove and reapply, self-aligning false eyelash without the use of adhesives. Moreover, because both the upper and lower assemblies can contain eyelash hairs, twice the fullness can be achieved, when compared to false eyelashes in the prior art.

DETAILED DESCRIPTION OF THE INVENTION

Figure 1:
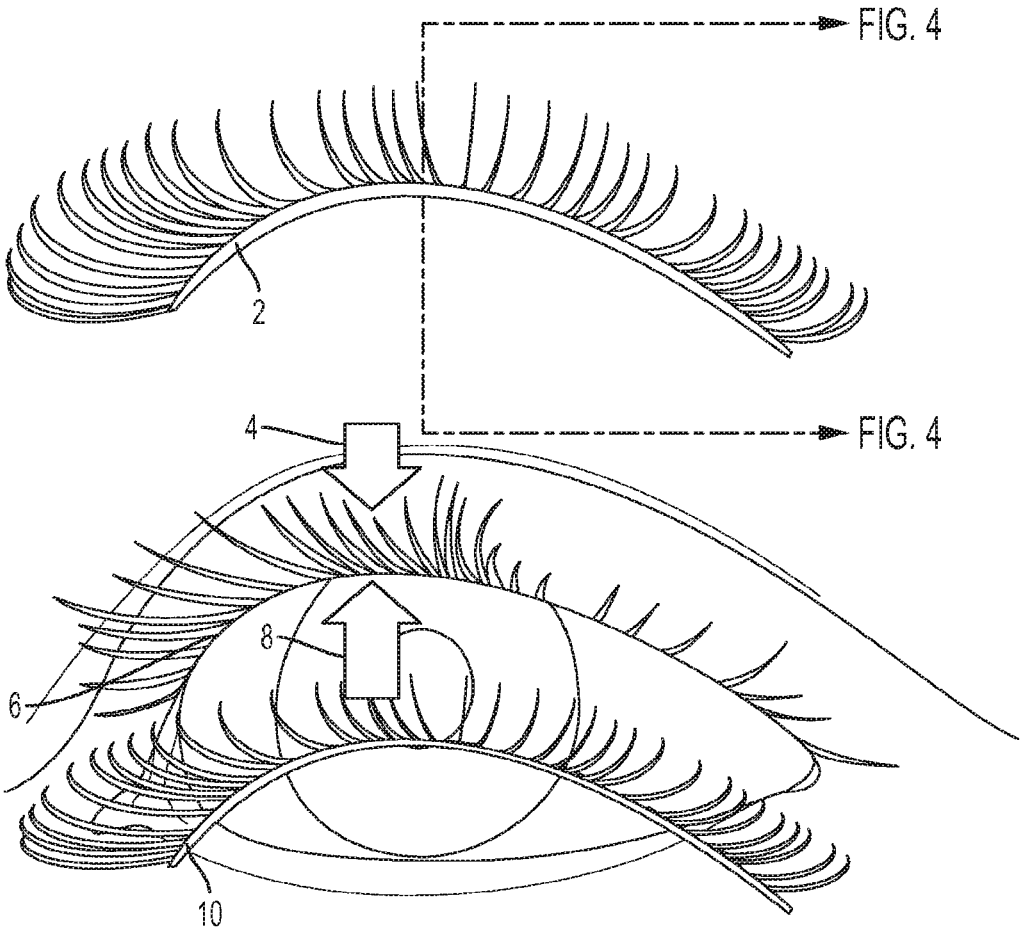
FIG. 1 is a frontal view of a human eye in which a magnetic embodiment of the false eyelash system of the present invention is about to be installed on the upper eyelash of the wearer.

Referring first to FIG. 1 of the drawings, shown therein is a frontal view of a human eye in which a magnetic embodiment of the false eyelash of the present invention is about to be installed on the upper eyelash (6) of the wearer. The upper eyelash assembly (2) and lower eyelash assembly (10) are in position, respectively above and below the upper eyelash (6) of the wearer. In order to apply the false eyelash, the upper eyelash assembly (2) is moved in a downward direction (4) towards the wearer's upper eyelash (6) while the lower eyelash assembly (10) is moved in an upward direction (8) towards the towards the wearer's upper eyelash (6). As the upper and lower assemblies (2,10) approach each other, magnetic force urges them towards each other "sandwiching" the wearer's upper eyelash (6).

Figure 2:
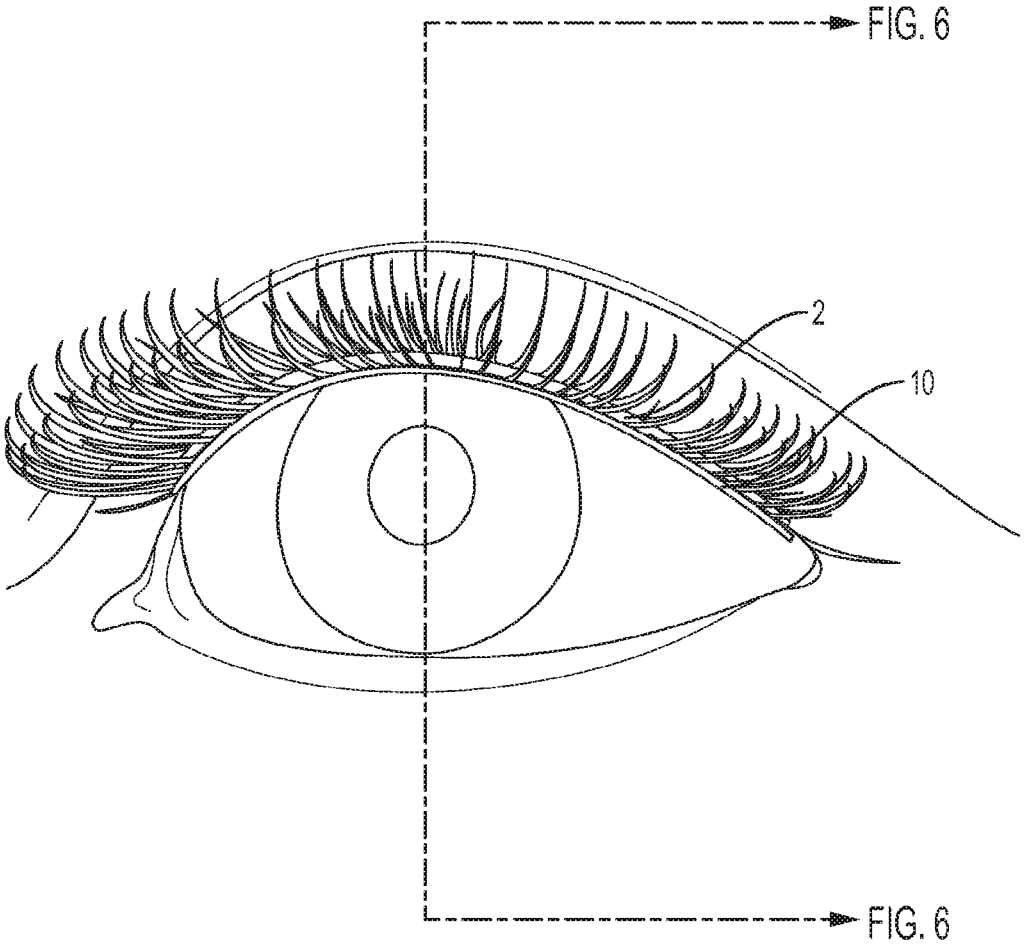
FIG. 2 is a frontal view of a human eye showing a magnetic embodiment of the false eyelash system of the present invention once installed on the upper eyelash of the wearer.

FIG. 2 shows the upper and lower eyelash assemblies (2,10) magnetically engaged with each other and installed on the wearer's upper eyelash (6). The assemblies are retained on the upper eyelash (6) by friction caused by the magnetic attraction between the two assemblies.

Figure 3:
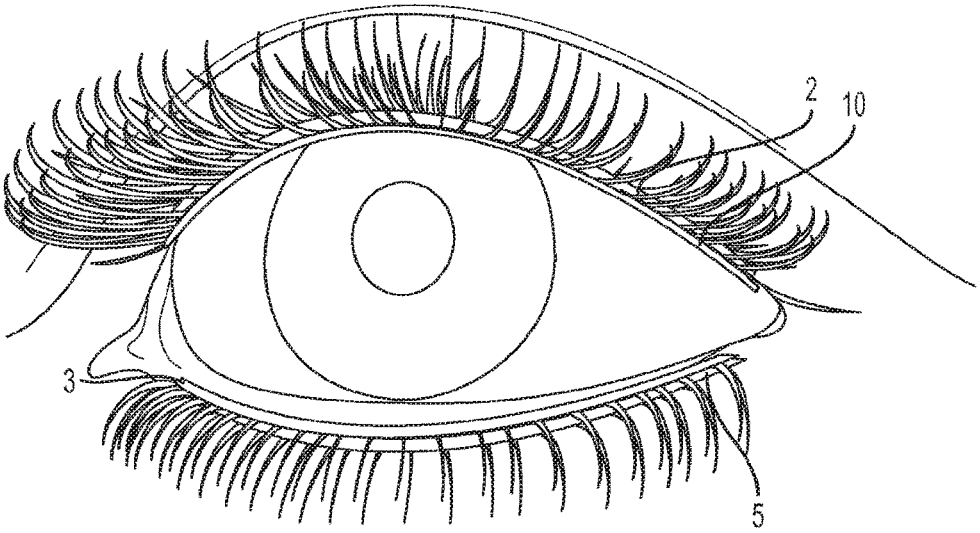
FIG. 3 is a frontal view of a human eye showing a magnetic embodiment of the false eyelash system of the present invention once installed on the upper and lower eyelashes of the wearer.

FIG. 3 shows an embodiment of the present invention incorporating assemblies for the upper and lower eyelashes of the wearer (not numbered). In addition to the upper and lower eyelash assemblies for the upper eyelash (2,10), upper and lower assemblies for the lower eyelash (3,5) are shown after installation in a similar fashion to that described above in connection with FIG. 1.

Figure 4:
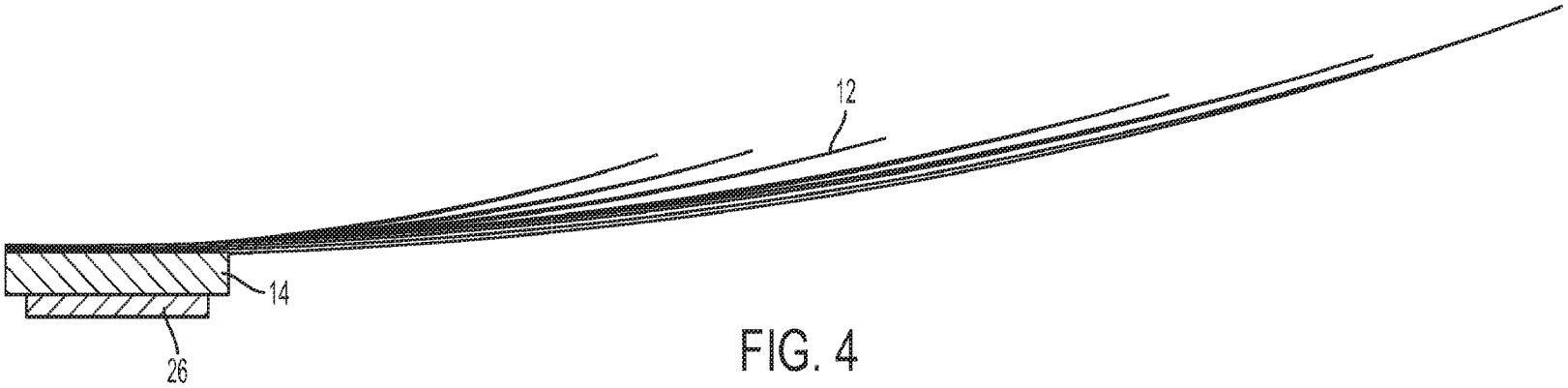
FIG. 4 is a cross sectional view of the upper eyelash assembly of an embodiment of the present invention in which magnetic elements are attached to the substrate strip.

FIG. 4 shows a cross sectional view of the upper eyelash assembly (2) of one embodiment of the present invention. Shown are a substrate strip (14), false eyelash hairs (12), and ail attractive element (26) attached to the substrate strip (14). The lower eyelash assembly (10) has similar construction. As indicated previously, the attractive element (26) can be magnetic, but of opposite polarities, on both the upper and lower eyelash assemblies (2,10) or can be magnetic in one assembly and metallic in the other.

Figure 5:
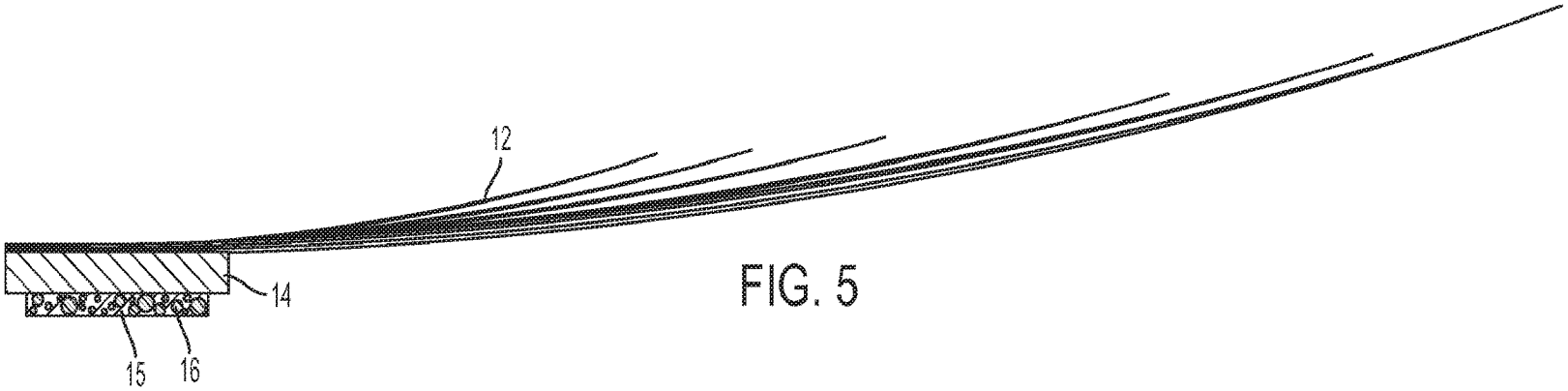
FIG. 5 is a cross sectional view of the upper eyelash assembly of an embodiment of the present invention in which magnetic elements are embedded within a coating in the substrate strip.

FIG. 5 shows an alternative embodiment of the upper eyelash assembly in which a coating with embedded metallic or magnetic particles is used. Shown are a substrate strip (14), false eyelash hairs (12), and a magnetic and/or metallic particles (16) embedded within a polymer coating (15) applied to the substrate strip. The lower eyelash assembly (10) has similar construction. As indicated previously, particles (16) can be magnetic, but of opposite polarities, on both the upper and lower eyelash assemblies (2,10) or can be magnetic in one assembly and metallic in the other.

An alternative embodiment of the present invention, not shown on the drawings, can incorporate substrate strips which themselves are embedded with metallic or magnetic particles. The substrate strip, in such a case, may be composed of a polymer or a plastic which can be molded and embedded with the particles. Alternatively, the magnetic elements may be placed on the lashes themselves, such as by coating the lashes with a magnetic material.

Figure 6:
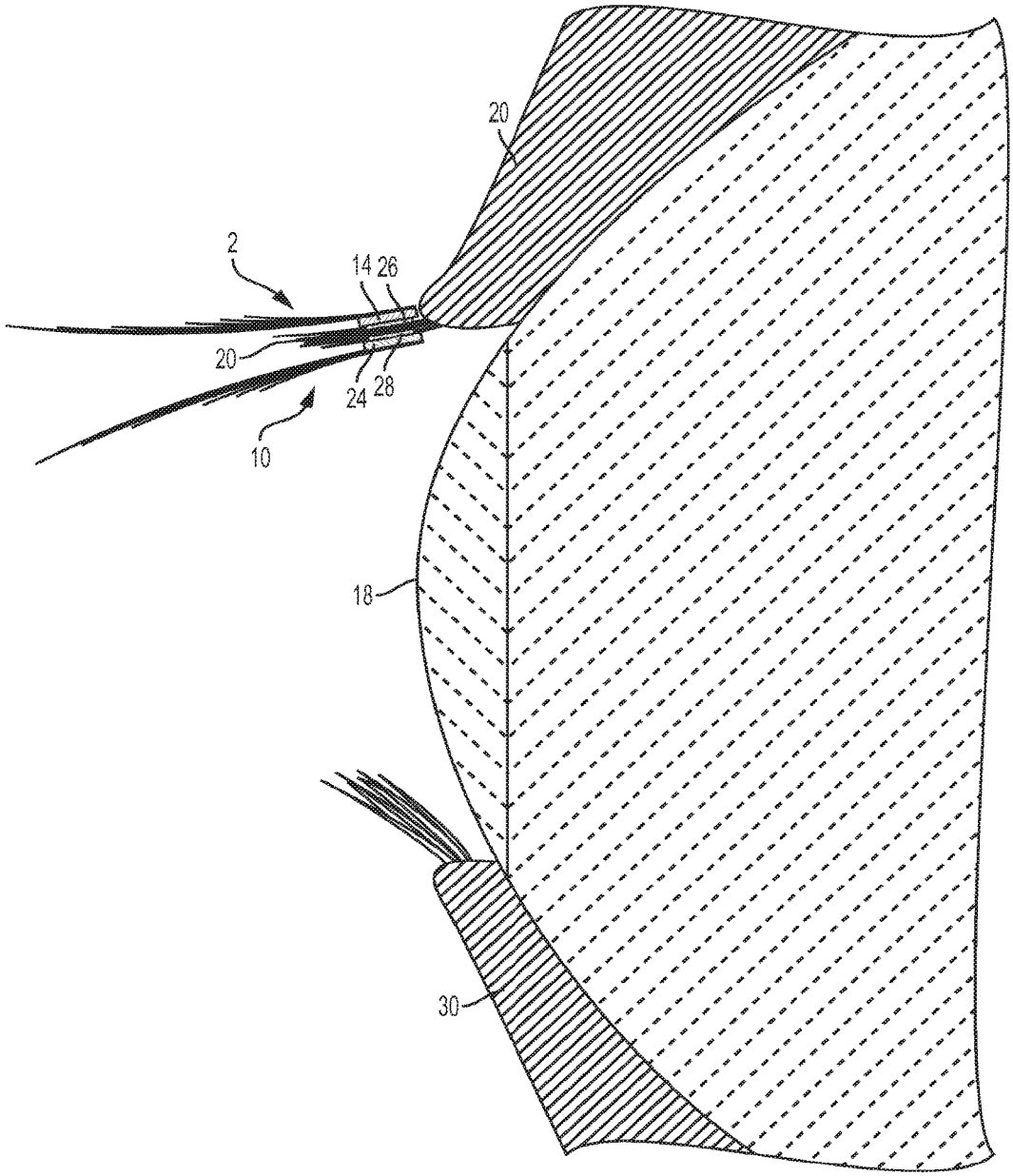
FIG. 6 is a cross-sectional view of a human eye showing a magnetic embodiment of the false eyelash system of the present invention once installed on the upper eyelash of the wearer.

FIG. 6 shows a cross sectional view of the installed upper eyelash on the wearer's eye in accordance with FIG. 2 using discrete attractive elements (per FIG. 4). As illustrated, the upper and lower eyelash assemblies (2,10) sandwich the wearer's upper eyelash (20). The attractive elements (26,28) attached to the substrate strips (14,24) are magnetically engaged and frictionally secured to the wearer's natural eyelash (20).

Figure 7:
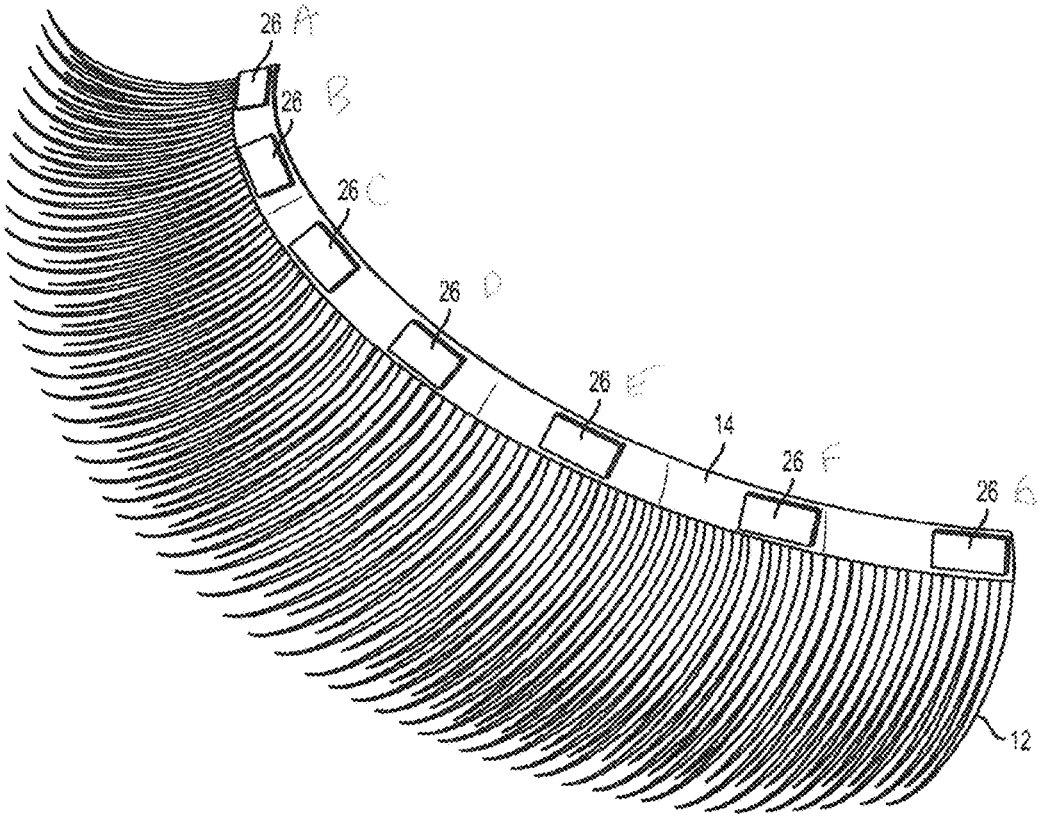
FIG. 7 is a perspective view of an eyelash assembly of an embodiment of the present invention in which magnetic elements are attached at discrete locations along the substrate strip.
Figure 8:
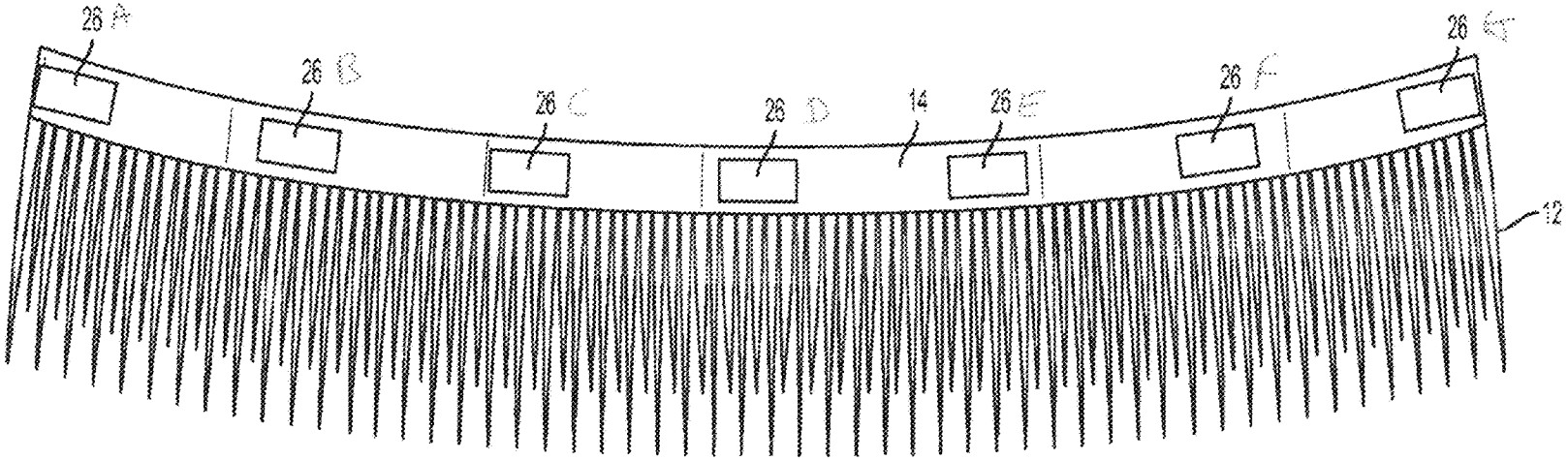
FIG. 8 is a plan view of an eyelash assembly of an embodiment of the present invention in which magnetic elements are attached at discrete locations along the substrate strip.
Figure 9:
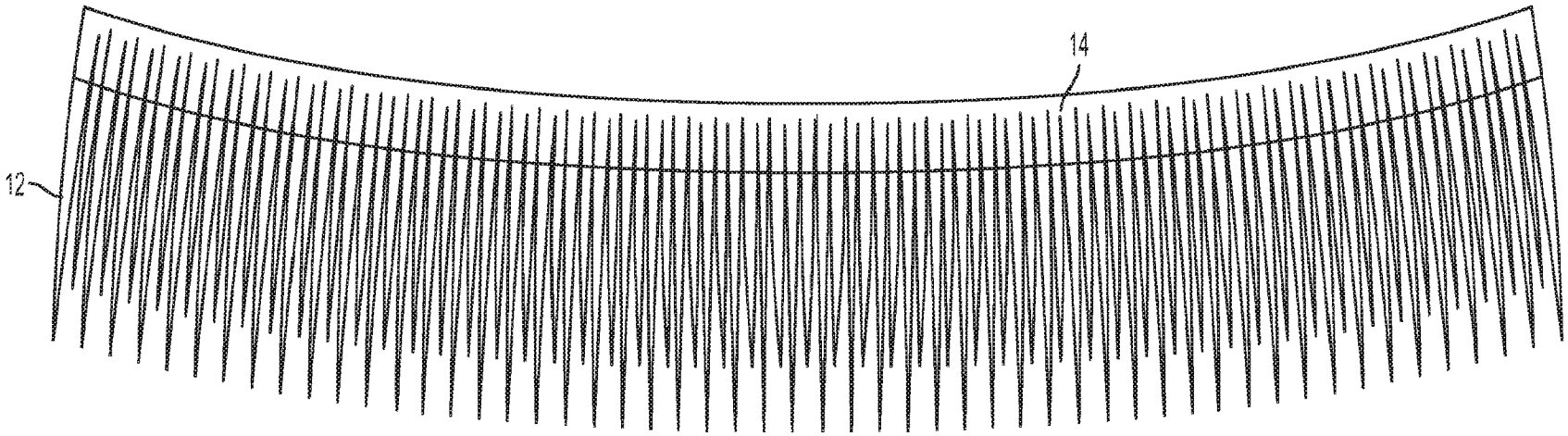
FIG. 9 is a plan view of an eyelash assembly of FIG. 8 shown from the opposite side.

FIGS. 7, 8 and 9 show various views of an eyelash assembly of an embodiment of the present invention in which magnetic elements are attached at discrete locations along the substrate strip in accordance with FIG. 4. As explained previously, eyelash hairs (12) are affixed to substrate strip (14) and metallic or magnetic elements (26) are attached to the substrate strip at discrete locations, shown as 26A-26G in FIGS. 7 and 8, with magnetic elements 26A and 26G located at the distal ends of the strip (14); magnetic elements 26B, 26C, 26D, 26E and 26F located intermediate the distal ends of the strip (14); and magnetic elements 26C, 26D and 26E located near the center of the strip (14).

Although the present invention is described above in connection with a magnetic false eyelash having a particular arrangement of upper and lower eyelash assemblies, and corresponding magnetic and metallic elements, these descriptions are not intended to be limiting as various modifications may be made therein without departing from the spirit of the invention and within the scope and range of equivalents of the following claims.

For example, although the described embodiments utilize magnetic and metallic elements to create an attractive force between the upper and lower eyelash assemblies, other types of elements, also creating an attractive force, may be used without departing from the spirit of the present invention. Non-limiting examples of such elements include: (a) hook and loop material (commercially known as Velcro®); (b) static-cling plastics; (c) micro suction cups and similar micro-suction technology; or any number of other materials.

Although the invention is described herein in sufficient detail to enable those of ordinary skill in the relevant art to practice it, various modifications and structural changes may be made therein without departing from the spirit of the invention and within the scope and range of equivalents of the claims.

I claim:

1. A false eyelash system comprising:

a first and second artificial eyelash assembly, the first artificial eyelash assembly configured to be positioned on top of a wearer's upper eyelash and the second artificial eyelash assembly configured to be positioned under a wearer's upper eyelash;

each of the first and second artificial eyelash assemblies including: a substrate strip having a top surface and an opposing bottom surface defining a length of the substrate strip, two opposing distal ends, and a central region located between the distal ends;

artificial eyelash hairs attached to each of the first and second artificial eyelash assembly substrate strips;

three rectangular plate magnets attached at first spaced apart locations along the central region of the bottom surface of the substrate strip of the first artificial eyelash assembly;

three rectangular plate magnets attached at second spaced apart locations along the central region of the top surface of the substrate strip of the second artificial eyelash assembly, where the first and second spaced apart locations are at corresponding locations on each substrate strip such that when the opposing distal ends of the first and second substrate strips are aligned and in contact, the three rectangular plate magnets of each strip overlap and engage in magnetic attraction; and, whereby placement of the first artificial eyelash assembly above the wearer's upper eyelash, adjacent the upper eyelid edge and placement of the second artificial eyelash assembly below the wearer's upper eyelash, adjacent the eyelid edge, allows engagement of the magnets of the first and second artificial eyelash assemblies so that the first and second eyelash assemblies are magnetically secured to the wearer's natural upper eyelash.

2. A false eyelash system comprising:

a first and second artificial eyelash assembly, the first artificial eyelash assembly configured to be positioned on top of a wearer's upper eyelash and the second artificial eyelash assembly configured to be positioned under a wearer's upper eyelash;

each of the first and second artificial eyelash assemblies including: a substrate strip having a top surface and an opposing bottom surface defining a length of the substrate strip, two opposing distal ends, and a central region located between the distal ends artificial eyelash hairs attached to each of the first and second artificial eyelash assembly substrate strips;

a plurality of magnetic elements attached at first spaced apart locations along the central region of the bottom surface of the substrate strip of the first artificial eyelash assembly;

a plurality of magnetic elements attached at second spaced apart locations along the central region of the top surface of the substrate strip of the second artificial eyelash assembly, where the first and second spaced apart locations are at corresponding locations on each substrate strip such that when the opposing distal ends of the first and second substrate strips are aligned and in contact, the three rectangular plate magnets of each strip overlap and engage in magnetic attraction; and, whereby placement of the first artificial eyelash assembly above the wearer's upper eyelash, adjacent the upper eyelid edge and placement of the second artificial eyelash assembly below the wearer's upper eyelash, adjacent the eyelid edge, allows engagement of the magnets of the first and second artificial eyelash assemblies so that the first and second eyelash assemblies are magnetically secured to the wearer's natural upper eyelash.

3. The false eyelash system of claim 2 wherein the magnetic elements are plates.

4. The false eyelash system of claim 2 wherein the magnetic elements are rectangular.

5. The false eyelash system of claim 2 where the magnetic elements are rectangular plates.

6. A process of applying false eyelashes to natural eyelashes of a wearer comprising:

providing a first and second artificial eyelash assembly, the first artificial eyelash assembly configured to be positioned on top of a wearer's upper eyelash and the second artificial eyelash assembly configured to be positioned on bottom of a wearer's upper eyelash;

each of the first and second artificial eyelash assemblies including:

a substrate strip having a top surface and an opposing bottom surface defining a length of the substrate strip, two opposing distal ends and a central region located between the distal ends;

artificial eyelash hairs attached to each of the first and second artificial eyelash assembly substrate strips;

three rectangular plate magnets attached at first spaced apart locations along the central region of the bottom surface of the substrate strip of the first artificial eyelash assembly;

three rectangular plate magnets attached at second spaced apart locations along the central region of the top surface of the substrate strip of the second artificial eyelash assembly where the first and second spaced apart locations are at corresponding locations on each substrate strip such that when the opposing distal ends of the first and second substrate strips are aligned and in contact, the three rectangular plate magnets of each strip overlap and engage in magnetic attraction; and, placing the first artificial eyelash assembly adjacent to and on a top edge of one of the wearer's natural eyelash;

placing the second artificial eyelash assembly adjacent to and under the same one eyelash; and, magnetically engaging and securing the wearer's same one natural eyelash between the first and second eyelash assemblies.

7. A process of applying false eyelashes to natural eyelashes of a wearer comprising:

providing a first and second artificial eyelash assembly, the first artificial eyelash assembly configured to be positioned on top of a wearer's upper eyelash and the second artificial eyelash assembly configured to be positioned on bottom of a wearer's upper eyelash;

each of the first and second artificial eyelash assemblies including:

a substrate strip having a top surface and an opposing bottom surface defining a length of the substrate strip, two opposing distal ends and a central region located between the distal ends;

artificial eyelash hairs attached to each of the first and second artificial eyelash assembly substrate strips;

a plurality of magnetic elements attached at first spaced apart locations along the central region of the bottom surface of the substrate strip of the first artificial eyelash assembly;

a plurality of magnetic elements attached at second spaced apart locations along the central region of the top surface of the substrate strip of the second artificial eyelash assembly where the first and second spaced apart locations are at corresponding locations on each substrate strip such that when the opposing distal ends of the first and second substrate strips are aligned and in contact, the plurality of magnetic elements of each strip overlap and engage in magnetic attraction; and, placing the first artificial eyelash assembly adjacent to and on top of the wearer's natural eyelash;

placing the second artificial eyelash assembly adjacent to and under the wearer's natural upper eyelash; and, magnetically engaging and securing the wearer's natural upper eyelash between the first artificial eyelash assembly and the second artificial eyelash assembly.

8. The process of claim 7 wherein the magnetic elements are plates.

9. The process of claim 7 wherein the magnetic elements are rectangular.

10. The process of claim 7 where the magnetic elements are rectangular plates.

* * * * *